United States Patent [19]

Ogawa

[11] 4,150,508

[45] Apr. 24, 1979

[54] VEHICLE TOY WITH FIRING MECHANISM

[75] Inventor: Iwakichi Ogawa, Kashiwa, Japan

[73] Assignee: Takara Co., Ltd., Tokyo, Japan

[21] Appl. No.: 792,538

[22] Filed: May 2, 1977

[51] Int. Cl.[2] ..... A63H 11/10

[52] U.S. Cl. ..... 46/202; 46/206; 46/223; 124/25

[58] Field of Search ..... 46/202, 17, 16, 201, 46/1 E, 112, 204, 206, 221, 222, 223; 273/101; 124/25

[56] References Cited

U.S. PATENT DOCUMENTS

| | | | |
|---|---|---|---|
| D. 186,987 | 1/1960 | Dickinson | 124/25 X |
| 3,010,718 | 11/1961 | Pearson, Jr. | 46/1 E X |
| 3,961,440 | 6/1976 | Saito | 46/206 |
| 4,073,086 | 2/1978 | Ogawa | 46/206 X |
| 4,073,087 | 2/1978 | Ieda | 46/202 |

*Primary Examiner*—Louis G. Mancene
*Assistant Examiner*—Mickey Yu
*Attorney, Agent, or Firm*—Harold L. Jackson; Stanley R. Jones; Joseph W. Price

[57] ABSTRACT

A combination vehicle toy and projectile firing mechanism is provided. The vehicle body member has a configuration that simulates a handgun when a plurality of appended members that provide locomotion are removed from the body member. A pair of guiderails and a pivoted lever trigger is mounted on the bottom of the body member and cooperates with a cross bar member to propel an arrow-like projectile. Preferably the body member has a tricycle configuration and an auxiliary motor assembly can be removably attached to provide independent locomotion.

13 Claims, 3 Drawing Figures

VEHICLE TOY WITH FIRING MECHANISM

BACKGROUND OF THE INVENTION

1. Field of the Invention

The present invention is directed to the toy industry and more particularly to a mobile toy assembly that incorporates a firing mechanism in the body of the toy.

2. Description of the Prior Art

The toy industry has provided a large number of variously designed mobile toys for use by children. The vehicle toys that are provided, are generally limited to a relatively few play options for the child. Since a child's span of attention is somewhat limited, the enjoyment value of a toy will increase proportionately to the variation of toy embodiments and functions. Thus, the prior art is always receptive to innovative toy assemblies that increase the number of play options available to a child.

SUMMARY OF THE INVENTION

The present invention provides a combination mobile toy and projectile firing device that can be used both as a vehicle and alternatively as a simulated handgun toy. In the vehicle mode of operation, a plurality of appended members such as wheels can be attached to the body member to provide locomotion. A cross bar member can extend outward from the sides of the body member to simulate a foot rest for an operator. This cross bar member can also be converted into a component part of a projectile firing mechanism when the appended members are removed and the body member is inverted. A pivotally mounted lever is provided on the bottom of the body member and is operatively positioned relative to a pair of spaced alignment rails. The alignment rails are capable of restraining a resilient member mounted on the cross bar member and also supporting a projectile having a shaft and a plurality of fins dimensioned for support on the top of the rail members.

While various configurations of the body member are possible, the preferred embodiment is in the form of a tricycle vehicle that can removably receive a motor assembly. A simulated operator seat has a high back member that can double in function as a hand grip when the vehicle is converted into a simulated handgun.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DESCRIPTION OF THE PREFERRED EMBODIMENT

The following description is provided to enable any person skilled in the toy industry to make and use the inventions and it sets forth the best modes contemplated by the inventor of carrying out his inventions. Various modifications, however, will remain readily apparent to those skilled in the toy industry, since the generic principles of the present invention have been defined herein specifically to provide a relatively economical and easily manufactured convertible mobile toy assembly.

Figure 1:
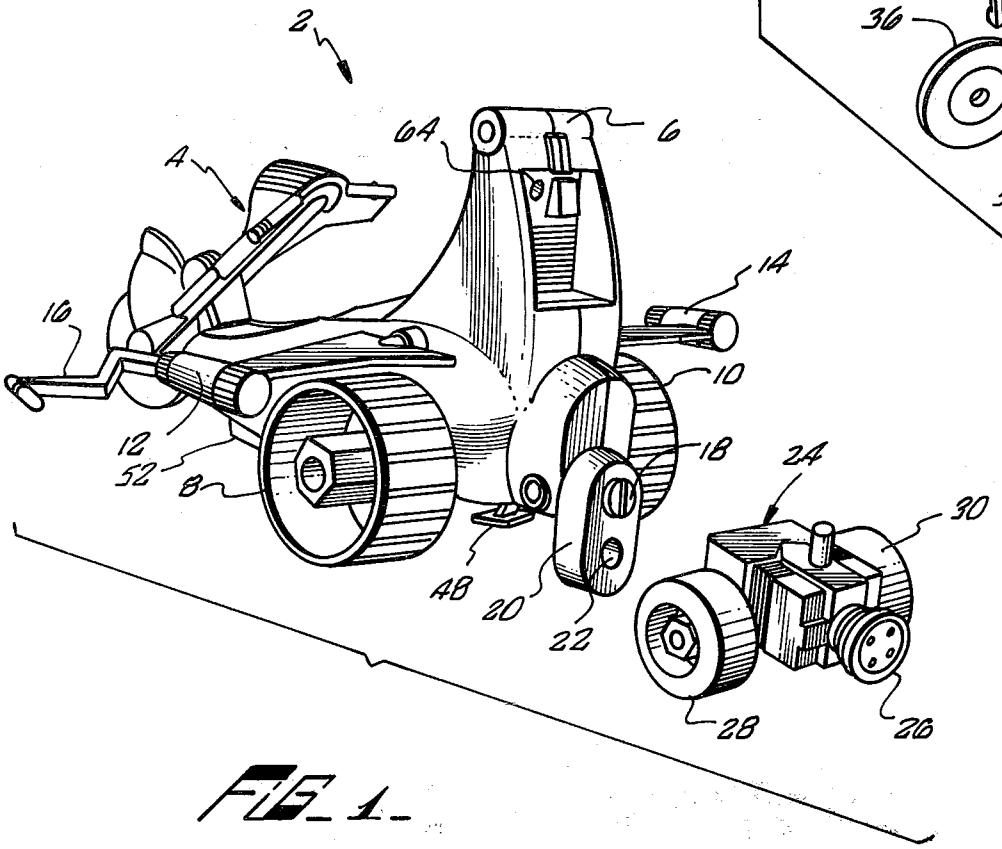
FIG. 1 is a back side perspective view of the present invention.

Referring to FIG. 1, a perspective view of the mobile toy assembly 2 is disclosed in the form of a tricycle vehicle. The toy body has a design to simulate actual vehicles that are in effect, a modification or derivation of motorcycles. In this regard, a single wheel steering column 4 is removably attached to the front of the body member 6 and large rear wheels 8 and 10, are rotatably and removably attached to the body member 6. Spoilers or wing members 12 and 14 can be removably attached to the side of the body member 6.

Mounted at the front of the body member 6, adjacent the steering column 4, is a cross bar member 16 that extends outward from either side of the body member 6 and simulates a footrest for an operator. Rotatably mounted on a bifurcated male coupling member 18 at the rear of the body member 6 is a female coupling block 20. An eccentrically mounted coupling aperture 22 on the coupling block 20 is designed to receive a press-fitted male stud (not shown) protruding from the front of a spring driven motor assembly 24. The male stud member is similar to the vertical male stud member disclosed in FIG. 1 on the top of the motor assembly 24.

Basically, the motor assembly 24 includes a spring driven shaft that can store energy by rotation of an operator knob 26. The wheels 28 and 30 are driven by the spring motor. This motor assembly 24 is adapted to be mounted on numerous combinations of toys and by itself does not form the invention described herein. Other forms of motor assemblies can also be attached and thus the present invention can in one or more of its embodiment forms be described as a combination toy with a motor assembly. For this reason, the specifics of the motor assembly are not deemed necessary to be described in greater detail because spring driven motors are readily available in the prior art.

Figure 2:
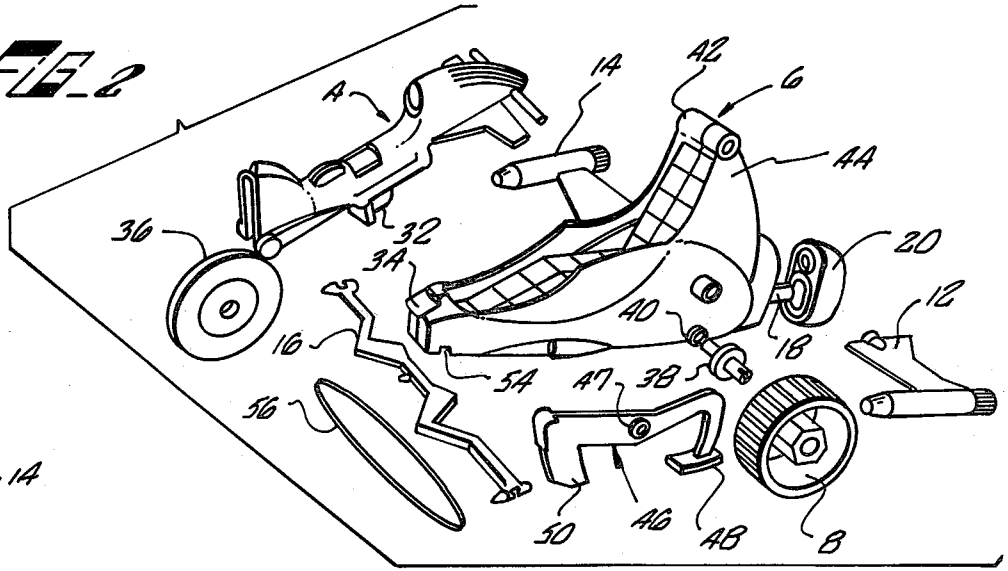
FIG. 2 is an exploded front side perspective view of the present invention.

Referring to FIG. 2, an exploded view of the present invention is disclosed. As can be seen, the steering column 4 can be attached to the body member 6 through the interface of a male stud member 32 and a female coupling member 34 mounted on the front of the body member 6. A press fit front wheel 36 is mounted on the steering column 4.

Coupling shafts 38 having a bifurcated camming stud can be respectively mounted on either side of the body member 6 in appropriate female apertures 40. The coupling shafts 38 rotatably mount the rear wheels 8 and 10 which have a reduced central bore for depressing the bifurcated split ends of the stud members during insertion and then release them for locking the rear wheel onto the coupling shaft 38.

The body member 6 comprises a pair of half shells 42 and 44 that can be held together by appropriate fasteners such as self-threading screws (not shown) and also by the mounting of the female coupling block 20 onto the rear male coupling member 18.

Figure 3:
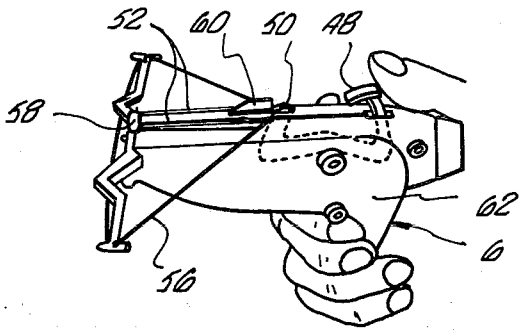
FIG. 3 is a side perspective view of a simulated handgun embodiment of the present invention.

As can be seen in FIGS. 2 and 3, a trigger lever 46 can be pivotally mounted at the bottom of the body member 6. A central bore 47 is provided for receiving a pin or shaft (not shown) extending from one of the half shell body members into a female aperture on the other half shell body member. Appropriate square apertures are formed on the bottom of the body member between the interface of the half shells to respectively capture a trigger button 48 and to permit a firing tip 50 of the lever 46 to pass between the ends of a pair of spaced parallel alignment rails 52.

The cross bar member 16 is designed to be mounted by its middle portion in a transverse slot 54 that extends across the bottom of both half shell members. Appropriate alignment pins and slots can be provided to insure a firm press fit mounting. A resilient member 56 such as a rubber band can be stretched and mounted on appropriate notches at both ends of the cross bar member 16. As can be seen in FIG. 3, one or more sides of the rubber band can be stretched and restrained on the rear edges of the alignment rails 52. An arrow-like projectile 58 having tail wings 60 is designed to be supported on the top edges of the alignment rails 52. Release of the restrained rubber band propels the projectile 58 from the handgun at an appropriate target.

The body member 6 includes a simulated operator seat as can be seen in FIG. 2. When the plurality of appended members that provide locomotion are removed and the body member 6 is inverted, the upper portion of the operator seat 62, can form a hand grip to simulate a handgun as shown in FIG. 3. In this regard, the operator can depress the trigger button 48 which will rotate the firing tip 50 to release the stressed resilient member 56. The resilient member 56 will impact the tail wing 60 and project the arrow-like projectile 58 along the alignment rails 52 towards a target. The projectile 58 can incorporate an appropriate soft tip to render its use by children safe.

The rear of the operator seat further includes one or more female coupling apertures 64 to permit a press fit attachment of other appended accessory items or even the spoilers 14 to provide a different design configuration at the option of the child. Accordingly, a child can play with the mobile toy in the form of a tricycle vehicle as disclosed in FIG. 1. The dimensions of this toy are such that they are compatible with an operator figurine (not shown) that can be common to this toy assembly as well as to many other toy assemblies thereby defining an interchangeable product line. Various appended accessory items such as the motor assembly 24 can be mounted on the toy assembly and the toy assembly itself can be reconfigured as desired by the child.

One of the principal advantages of the present invention is that it permits the child to be stimulated with a radically different toy from some of the same basic component parts that provide a vehicle mode of operation. As can be seen in FIG. 3, the removal of the appended members that are principally attached to the body member to provide locomotion and the inverting of the body member 6 permits the child to simulate a handgun. This simulation includes the capability of firing a projectile by the actuation of a trigger button 48 that is pivotally mounted on the bottom of the vehicle.

As can be appreciated, the component parts are advantageously formed from an injection molded plastic and various other configurations and surface indicia and design can be subjectively added to the toy. Since other modifications are possible by a person skilled in the toy industry, once given the generic principles of the present invention the actual scope of the present invention should be determined solely from the claims which I claim:

What is claimed is:

1. A combination mobile toy and projectile firing device comprising;

a body member having a simulated operator seat;

a cross bar member extending outward from either side of the body member and positioned to simulate a foot rest for an operator;

a plurality of appended members attached to the body member to provide locomotion, and means operatively associated with the cross bar member for projecting a projectile.

2. The invention of claim 1 wherein the body member has an approximately L-shape.

3. The invention of claim 1 wherein the means operatively associated with the cross bar member to project the projectile includes a bow-like configuration member connected to the body member and a resilient member connected to the bow member.

4. The invention of claim 1 wherein the body member has a pair of spaced alignment rails on its bottom side.

5. The invention of claim 1 wherein the body member has a configuration of a tricycle vehicle and three wheeled appended members are removably attached to the body member.

6. The invention of claim 5 wherein one of the wheeled appended members includes a steering assembly.

7. The invention of claim 6 further including a removable motor assembly mounted on the body member for driving the mobile toy.

8. The invention of claim 7 further including a rotatable coupling member mounted on the rear of the body member for removably engaging the motor assembly.

9. The invention of claim 1 wherein the means operatively associated with the cross bar member for projecting a projectile includes a pivotally mounted operator actuated lever, the lever being mounted in the bottom of the body member.

10. The invention of claim 9 further including a resilient member connected to the cross bar member for propelling any projectile.

11. The invention of claim 10 further including a shaft member projectile having a plurality of fins at one end.

12. The invention of claim 11 wherein the means operatively associated with the cross bar member for projecting a projectile further includes a pair of spaced alignment rails mounted adjacent the lever and dimensioned to support a pair of the fins of the projectile, one end of the rails being capable of restraining the resilient member in a state of stress sufficient to propel the projectile.

13. The invention of claim 1 wherein the body member simulates the configuration of a tricycle vehicle and the simulated operator seat is of such a dimension to provide a hand gun grip to an operator whereby the toy can be used both as a vehicle and as a hand gun to fire projectiles.

* * * * *